US008424314B2

(12) United States Patent
Mazet

(10) Patent No.: US 8,424,314 B2
(45) **Date of Patent: *Apr. 23, 2013**

(54) INTERMETALLIC COMPOUNDS, THEIR USE AND A PROCESS FOR PREPARING THE SAME

(75) Inventor: Thomas Mazet, Villers-les-Nancy (FR)

(73) Assignee: Universite Henri Poincare Nancy 1, Nancy (FR)

( * ) Notice: Subject to any disclaimer, the term of this patent is extended or adjusted under 35 U.S.C. 154(b) by 248 days.

This patent is subject to a terminal disclaimer.

(21) Appl. No.: 12/935,090

(22) PCT Filed: Mar. 27, 2009

(86) PCT No.: PCT/EP2009/053671

§ 371 (c)(1),
(2), (4) Date: Nov. 3, 2010

(87) PCT Pub. No.: WO2009/121811

PCT Pub. Date: Oct. 8, 2009

(65) Prior Publication Data

US 2011/0049413 A1 Mar. 3, 2011

(30) Foreign Application Priority Data

Mar. 31, 2008 (EP) ..... 08290306

(51) Int. Cl.

| | |
|---|---|
| ***F25B 21/00*** | (2006.01) |
| ***H01F 1/00*** | (2006.01) |
| ***H01F 1/03*** | (2006.01) |
| ***C21D 1/00*** | (2006.01) |

(52) U.S. Cl.
USPC ..... 62/3.1; 148/100; 148/300; 148/301; 148/314; 148/315; 419/29

(58) Field of Classification Search ..... 148/100, 148/300, 314; 62/3.1
See application file for complete search history.

(56) References Cited

U.S. PATENT DOCUMENTS

2007/0072077 A1* 3/2007 Kusumoto et al. ..... 429/218.1
2010/0276627 A1* 11/2010 Mazet ..... 252/62.55

OTHER PUBLICATIONS

Mazet et al., "Mn3Sn2: A promising material for magnetic refrigeration", Applied Physics Letters, Jul. 10, 2006, vol. 89, No. 2, pp. 022503-1-022503-3.*
Richard M-A et al: "Magnetic refrigeration: Single and multimaterial active magnetic regenerator experiments", Journal of Applied Physics, Feb. 15, 2004, pp. 2146-2150,vol. 95, No. 4, American Institute of Physics. New York, US, XP012067451.
Mazet T et al: "Mn3Sn2: A promising material for magnetic refrigeration", Applied Physics Letters, Jul. 10, 2006, pp. 22503-022503, vol. 89, No. 2, AIP, American Institute of Physics Melville, NY, XP012086976.
Recour Q et al: "Magnetic and magnetocaloric properties of Mn3-xFexSn2 (0.1=<x=<0.9)", Journal of Physics D: Applied Physics, Aug. 28, 2008, pp. 185002-1, vol. 41, XP002496641.
International Search Report, dated Jun. 5, 2009, in Application No. PCT/EP2009/053671.

* cited by examiner

*Primary Examiner* — Roy King
*Assistant Examiner* — Timothy Haug
(74) *Attorney, Agent, or Firm* — Young & Thompson

(57) ABSTRACT

The present invention relates to new intermetallic compounds having a crystalline structure of $Ni_3Sn_2$ type for the magnetic refrigeration, their use and a process for preparing the same. The present invention further relates to new magnetocaloric compositions for the magnetic refrigeration and their use.

34 Claims, 9 Drawing Sheets

| Compound | Type | Weight fractions | a (Å) | b (Å) | c (Å) |
|---|---|---|---|---|---|
| $Mn_{2.9}Cu_{0.1}Sn_2$ | $Ni_3Sn_2$ | 100% | 7.549(1) | 5.504(1) | 8.580(1) |
| | $Ni_2In$ | 0% | - | - | - |
| $Mn_{2.8}Cu_{0.2}Sn_2$ | $Ni_3Sn_2$ | 85% | 7.551(1) | 5.511(1) | 8.596(1) |
| | $Ni_2In$ | 15% | 4.369(1) | 4.369(1) | 5.536(1) |
| $Mn_{2.7}Cu_{0.3}Sn_2$ | $Ni_3Sn_2$ | 25% | 7.551(1) | 5.515(1) | 8.615(1) |
| | $Ni_2In$ | 75% | 4.365(1) | 4.365(1) | 5.552(1) |

FIGURE 2

INTERMETALLIC COMPOUNDS, THEIR USE AND A PROCESS FOR PREPARING THE SAME

CROSS REFERENCE TO RELATED APPLICATIONS

This Application is a National Stage Application of PCT/EP2009/053671 filed on Mar. 27, 2009 which claims the benefit of priority from European Patent Application 08290306.3 filed on Mar. 31, 2008.

The present invention relates to new intermetallic compounds, their use and a process for preparing the same.

Current refrigeration systems and air conditioners are based on conventional gas compression and still use ozone-depleting or global warming volatile liquid refrigerant, thus representing a great environmental impact.

To circumvent these drawbacks, magnetic refrigeration using magnetocaloric compounds has been developed.

The magnetic refrigeration is expected to become competitive with conventional gas compression in a near future because of its higher efficiency and its lower environmental impact (Gschneidner K. A. et al., *Annu. Rev. Mater. Sci.,* 30, 387, 2000; Tishin A. M. et al., *The magnetocaloric effect and its applications*, (Institute of physics Publishing, Bristol, 2003); Gschneidner K. A. et al., *Rep. Prog., Phys.* 68, 1479, 2005) and the magnetocaloric effect (MCE), widely speaking the adiabatic temperature change ($\Delta T_{ad}$) or the isothermal magnetic entropy change ($\Delta S_M$) of a solid in a varying magnetic field, is the heart of this cooling technique.

Since the discovery of the giant magnetocaloric effect (GMCE) in $Gd_5Si_2Ge_2$ (Pecharsky V. K. et al., *Phys. Rev. Lett.* 78, 4494, (1997), there has been a significant increase in prospecting on refrigerant materials.

Giant magnetocaloric properties are generally connected to first-order magnetic transitions (FOMT) which yield an intense but sharp response by opposition with the broader and less intense peak produced by second-order magnetic transitions (SOMT).

The phase transition can be a first-order phase transition which exhibits a discontinuity in the first derivative of the free energy with a thermodynamic variable, or a second-order phase transition which have a discontinuity in a second derivative of the free energy.

In a first order phase transition, there is a latent heat, the change from one phase to another is abrupt and a structural modification is possible.

Research has first been mostly restricted to rare earth compounds due to their high magnetic moment. Thus, U.S. Pat. No. 5,362,339 discloses magnetocaloric compounds having the following general formula $Ln_aA_bM_c$ wherein Ln is a rare earth element selected from the group consisting of Ce, Pr, Nd, Sm, Eu, Gd, Tb, Dy, Ho, Er, Tm and Yb, A is Al or Ga and M is selected from the group consisting of Fe, Co, Ni, Cu and Ag.

However these magnetocaloric compounds have two major drawbacks, a high cost due to the presence of expensive elements such as Gd and a temperature of use which is too low to be applicable near or above room temperature, i.e. from about 200 to about 600K.

Another interesting type of materials is rare earth-transition metal compounds crystallizing in the cubic $NaZn_{13}$ type of structure. Recently, because of the extremely sharp magnetic ordering transition, the (La,Fe,Si,Al) system was reinvestigated. U.S. Pat. No. 7,063,754 discloses compounds of formula $La(Fe_{1-x}M_x)_{13}H_z$ where M is selected from the group consisting of Si and Al. These compounds provide a magnetic material exhibiting magnetic phase transition in the room temperature region.

Nevertheless, the temperature of use is too limited and not compatible with various industrial systems. Furthermore, at the transition phase in $La(Fe,Si)_{13}$ type of alloys, a volume change of 1.5% is also observed (Wang et al., *J. Phys. Condens Matter,* 15, 5269-5278, 2003). If this volume change is performed very frequently the material definitely becomes very brittle and may break into even smaller grains. This can have a distinct influence on the corrosion resistance of the material and thus on the life time of a refrigerator (Brück E., *J. Phys. D: Appl. Phys.* 38, R381-R391, 2005).

The only way to circumvent this limited temperature of use is to make a composition comprising two compounds having different transitions temperatures and therefore leading to a broadened temperature of use.

However, this solution is not satisfying because it leads to a material with a less intense response due to the lower ratio of each compound.

Further, each of the compounds works in turn depending on its transition temperature. Therefore, the response of this type of compound is not constant.

Despite their lower atomic moments, intermetallic manganese (Mn)-based compounds are now especially studied because they often order near or above room temperature and are comparatively cheap. The more outstanding behaviours have been found in $FeMnP_{1-x}As_x$ (WO 2003/012801, WO 2004/068512) and $MnAs_{1-x}Sb_x$ (WO 03/009314) that exhibit a GMCE comparable to that of $Gd_5Si_2Ge_2$ around room temperature. However, in spite of reduced materials costs, the presence of the highly toxic material As does not allow an industrial use of these compounds.

Further, the hysteresis loss, i.e. systems that do not return completely to their original state: that is, systems the states of which depend on their immediate history, is a phenomena inherent in FOMT magnetic and ferromagnetic materials.

Moreover, the slow kinetic, also inherent in FOMT, may reduce the actual efficiency of the GMCE materials in fast-cycling refrigerators (Gschneidner K. A. et al., *Rep. Prog., Phys.* 68, 1479, 2005; Provenzano V. et al., *Nature,* 429, 853, 2004).

To summarize, the major drawbacks of the current magnetocaloric materials are:

- the presence of a FOMT, inherent with a hysteresis loss and with an intense but sharp response but therefore a limited temperature of use,
- the presence of highly toxic material,
- a generally high production cost, due to the presence of expensive raw materials.

Accordingly, one of the subjects of the invention is to provide magnetic compounds substituted by Fe, being in the form of an alloy, allowing a temperature of use greatly increased, a larger temperature span and presenting no hysteresis loss, in particular near the room temperature, as a magnetocaloric agent, in particular for magnetic refrigeration.

Another subject of the invention is to provide compositions of magnetic compounds wherein the association of two magnetic compounds yield to a larger temperature span, allowing their uses in various refrigeration systems.

Another subject of the invention is to provide a process of preparation of magnetic compounds.

Thus, the present invention relates to the use of at least one compound having the following general formula (I) and a crystalline structure of $Ni_3Sn_2$ type:

$$Mn_{3-(x+x')}Fe_xT'_{x'}Sn_{2-(y+y')}X_yX'_{y'} \quad (I)$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X and X' are chosen among: Ga, Ge, Sb, In, Al, Cd, As, P, C, Si, $0.5<x\leqq 1$, and $x'\leqq 0.5$ y and y' are comprised from 0 to 0.5, $y+y'\leqq 1$, and $x+x'+y+y'\leqq 2.5$, as a magnetocaloric agent, in particular for magnetic refrigeration.

The compounds of formula (I) used herein are in the form of alloys.

By "magnetocaloric agent", it is meant a compound able to exercise a magnetocaloric effect (MCE) such as defined above.

In the following of this specification, the different terms used, i.e. magnetic refrigerant, refrigerant material, magnetic material, magnetocaloric material, magnetocaloric agent, magnetocaloric compound have the same meaning and refer to a material adapted to the magnetic refrigeration.

When a material is magnetized in an applied magnetic field, the entropy associated with the magnetic degrees of freedom, the so-called magnetic entropy $S_m$, is changed as the field changes the magnetic order of the material. Under adiabatic conditions, $\Delta S_m$ must be compensated by an equal but opposite change of the entropy associated with the lattice, resulting in a change in temperature of the material.

This temperature change, $\Delta T_{ad}$ (or variation of the adiabatic temperature) is usually called "MCE" and reach maxima (or minima) at the transition temperature (i.e. the Curie temperature, the temperature where the material undergoes a change from a paramagnetic state to a ferromagnetic state).

Thus, the "transition temperature" or the phase transition or magnetic phase transition or phase change is the transformation of a thermodynamic system from one phase to another at a temperature change called Tc (also referred to peak herein) and at a maximum isothermal magnetic entropy change called $-\Delta S_M^{max}$.

In the present invention, it has been found that when the alloys having a crystalline structure of $Ni_3Sn_2$ type, i.e. orthorhombic Pnma, are substituted by a Fe content above 0.5 to about 1, they continue to exhibit at least two ferromagnetic transitions ($Tc_1$ and $Tc_2$), each of them being a second-order magnetic transition (SOMT), $Tc_1$ being increased from about 260K to about 300K and $Tc_2$ being decreased from about 200K to about 160K, while increasing the Fe content from 0.5 to 1, and retain the structure of $Ni_3Sn_2$ type whatever the Fe content, and presenting no hysteresis loss, allowing to extend the temperature span of use.

Upon increasing the Fe content from 0.5 to 1, the shape of the magnetocaloric response ($-\Delta S_M(T)$) evolves from that required for ideal Ericsson and Brayton cycles ($-\Delta S_M(T)$= constante) to that required by AMR (Active Magnetic Regenerator) cycles (linear thermal dependence of ($-\Delta S_M(T)$) allowing to adapt the shape of the magnetocaloric response to the desired cycle.

The temperature span depends on the location of the two second-order peaks ($Tc_1$ and $Tc_2$) and on the distance between said two peaks.

The occurrence of two magnetic entropy change maxima is not a common event, especially in the temperature range from 150K to 300K.

As already discussed above, giant magnetocaloric properties are generally connected to first-order magnetic transitions (FOMT) which yield an intense but sharp response by opposition with the broader and less intense peak produced by second-order magnetic transitions (SOMT).

In a second order phase transition, the change from one phase to another is continuous and there is no structural modification and no latent heat.

In addition, the kinetic is more rapid and the aging problem leading to the presence of very brittle material and even broken in smaller grains, influencing its corrosion resistance and then the lifetime of the system, is circumvented.

Another advantage of the invention is the low cost and the great availability of the major constituents, i.e. Mn and Sn and Fe of the compounds.

Still another advantage of the invention consists in the opportunity to obtain variations of $Tc_1$ and $Tc_2$ in function of the chemical replacement of a part of Mn by T' and/or a part of Sn by X and X' and the respective proportion of T', X, X', leading thus to magnetocaloric materials adapted to various uses.

Thus, the invention relates to the use of at least one of the above defined compounds, said compound comprising at least two phase transitions, each of them being of second order and constituting a peak, the maximum of which being increased with an increasing Fe content from 0.5 to 1.

Therefore, the compounds of formula (I) are alloys comprising six element.

According to a more preferred embodiment, the invention relates to the use of at least one of the above defined compounds having the following general formula (II) and a crystalline structure of $Ni_3Sn_2$ type:

$$Mn_{3-x}Fe_xSn_{2-(y+y')}X_yX'_{y'} \quad (II)$$

in which:

X and X' are chosen among: Ga, Ge, Sb, In, Al, Cd, As, P, C, Si, $0.5<x\leqq 1$, y and y' are comprised from 0 to 0.5, $y+y'\leqq 1$, and $x+y+y'\leqq 2.0$, as a magnetocaloric agent, in particular for magnetic refrigeration.

Therefore, the compounds of formula (II) are alloys comprising three, four or five elements depending of the value of y and y'.

According to another preferred embodiment, the invention relates to the use of at least one of the above defined compounds having the following general formula (III) and a crystalline structure of $Ni_3Sn_2$ type:

$$Mn_{3-(x+x')}Fe_xT'_{x'}Sn_{2-y}X_y \quad (III)$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X is chosen among: Ga, Ge, Sb, In, Al, Cd, As, P, C, Si, $0.5<x\leqq 1$, and $x'<0.5$, y is comprised from 0 to 1, and $x+x'+y\leqq 2.5$, as a magnetocaloric agent, in particular for magnetic refrigeration.

Therefore, the compounds of formula (III) are alloys comprising three, four or five elements depending of the value of x' and y.

According a preferred embodiment, the invention relates to the use of at least one of the above defined compounds, having the following general formula (IV) and a crystalline structure of $Ni_3Sn_2$ type:

$$Mn_{3-x}Fe_xSn_{2-y}X_y \quad (IV)$$

in which:

X is chosen among: Ga, Ge, Sb, In, Al, Cd, As, P, C, Si, $0.5<x\leqq 1$, y is comprised from 0 to 1, and $x+y\leqq 2$, as a magnetocaloric agent, in particular for magnetic refrigeration.

Therefore, the compounds of formula (IV) are alloys comprising three or four elements, depending of the value of x and y.

According to another preferred embodiment, the invention relates to the use of at least one of the above defined compounds, having the following general formula (V) and a crystalline structure of $Ni_3Sn_2$ type:

$$Mn_{3-(x+x')}Fe_xT'_{x'}Sn_2 \quad (V)$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, $0.5<x\leqq 1$, and $x'<0.5$, as a magnetocaloric agent, in particular for magnetic refrigeration.

Therefore, the compounds of formula (V) are alloys comprising three or four elements depending of the value of x'.

According to another preferred embodiment, the invention relates to the use of at least one of the above defined compounds, having the following general formula (VI) and a crystalline structure of $Ni_3Sn_2$ type:

$$Mn_{3-x}Fe_xSn_2 \quad (VI)$$

in which:

$0.5<x\leqq 1$, as a magnetocaloric agent, in particular for magnetic refrigeration.

Therefore, the compounds of formula (VI) are alloys comprising three elements.

According to another preferred embodiment, the invention relates to the use of at least one of the above defined compounds wherein the cooling capacity q for a magnetic field applied from more than 0 to about 5 T is comprised from about 50 mJ/cm$^3$ to about 5000 mJ/cm$^3$ particularly from about 100 mJ/cm$^3$ to about 4000 mJ/cm$^3$, more particularly from about 500 mJ/cm$^3$ to about 3000 mJ/cm$^3$ and more particularly from about 1000 mJ/cm$^3$ to about 2000 mJ/cm$^3$.

The refrigerant capacity (RC) of a magnetic refrigerant, that is the amount of heat which can be transferred in one thermodynamic cycle (Gschneidner K. A. et al., *Annu. Rev. Mater. Sci.,* 30, 387, 2000; Tishin A. M., et al., *The magnetocaloric effect and its applications*, (Institute of physics Publishing, Bristol, 2003; Gschneidner K. A. et al., *Tsokol, Rep. Prog., Phys.* 68, 1479, 2005; Wood M. E. et al., *Cryogenics,* 25, 667, 2001) can be calculated with three different methods:

1) first method: the numerical integration of the area under the $-\Delta S_m(T)$ curve between $T_1$ and $T_2$ leads to the cooling capacity $q=-\int_{T_1}^{T_2}\Delta S_M(T)dT$ (Gschneidner K. A. et al., *Annu. Rev. Mater. Sci.,* 30, 387, 2000; Gschneidner K. A. et al., *Tsokol, Rep. Prog., Phys.* 68, 1479, 2005),
2) second method: for a conventional 'caret-like' MCE behavior, the relative cooling power (RCP) is given by the product of the maximum $-\Delta S_m$ and full width at half maximum $\delta T_{FWHM}$:

$RCP=-\Delta S_M^{max}\times\delta T_{FWHM}$. The RCP is approximately 4/3 times larger than the cooling capacity q for the same temperature interval (Gschneidner K. A. et al., *Annu. Rev. Mater. Sci.,* 30, 387, 2000), 3) third method: it is described by Wood and Potter (Wood M. E. et al., *Cryogenics,* 25, 667, 2001). The refrigerant capacity is defined for a reversible cycle between $T_{hot}$ and $T_{cold}$ as $RC=-\Delta S_m\ \Delta T_{cycl}$ where $-\Delta S_m$ is the magnetic entropy change at the hot and cold ends of the cycle, which must be equal, and $\Delta T_{cycl}=T_{hot}-\Delta T_{cold}$. The maximum refrigerant capacity (MRC) is reached when $-\Delta S_m\ \Delta T_{cycl}$ is maximized, thus defining the hot and cold temperatures for which the material is the most effective (FIG. 1).

However, the refrigerant capacity (RC) which also takes into account the width and shape of $\Delta S_M$ vs T curves, is a more relevant parameter when evaluating the technological interest of a refrigerant material.

Based on this criterion, the gap between FOMT and SOMT materials becomes less impressive.

According to another preferred embodiment, the invention relates to the use of at least one of the above defined compounds wherein the variation of the magnetic entropy ($-\Delta S_M$) versus the temperature for a magnetic field applied from more than 0 to about 5 T is comprised from about 5 mJ/cm$^3$/K to about 100 mJ/cm$^3$/K particularly between 10 mJ/cm$^3$/K to about 50 mJ/cm$^3$/K, more particularly from about 15 mJ/cm$^3$/K to about 40 mJ/cm$^3$/K and more particularly from about 20 mJ/cm$^3$/K to about 30 mJ/cm$^3$/K.

According to another preferred embodiment, the invention relates to the use of at least one of the above defined compounds wherein the variation of the adiabatic temperature ($\Delta T_{ad}$) for a magnetic field applied from more than 0 to about 5 T is comprised from about 0.5 K to about 10 K, particularly from about 1 K to about 5 K and more particularly from about 1.5 K to about 3K.

According to another preferred embodiment, the invention relates to the use of at least one of the above defined compounds comprising two peaks which are in a temperature range from about 50 K to about 550 K, particularly from about 100 K to about 400 K, more particularly from about 150 K to about 350 K and more particularly from about 150 to about 300 K.

Therefore, one of the advantages of the Invention is to provide compounds having a temperature span broadened due to the presence of two transitions peaks.

FIG. 3 represents the variation of the temperature of transition versus the content of Fe in $Mn_{3-x}Fe_xSn_2$ (A) and the content of Cu in $Mn_{3-x}Cu_xSn_2$ (B).

Above 0.3, Cu being a non-magnetic element, the corresponding compounds are no more interesting for the magnetic refrigeration.

The temperature span of $Mn_{3-x}Fe_xSn_2$ is broadened by comparison with the temperature span of $Mn_{3-x}Cu_xSn_2$.

According to another preferred embodiment, the invention relates to the use of at least one compound wherein the temperature range between at least two adjacent peaks and particularly between all the adjacent peaks is comprised from about 20 K to about 150 K.

Table 1 represents the values of $Tc_1$, $Tc_2$ and the difference $Tc_1$-$Tc_2$ for the different Fe contents:

| Value of x ($Mn_3Fe_xSn_2$) | $Tc_1$ | $Tc_2$ | $Tc_1 - Tc_2$ |
|---|---|---|---|
| 0.1 | 259 | 205 | 54 |
| 0.2 | 258 | 208 | 50 |
| 0.3 | 259 | 208 | 51 |
| 0.4 | 260 | 197 | 63 |
| 0.5 | 261 | 193 | 68 |
| 0.6 | 268 | 185 | 83 |
| 0.7 | 271 | 183 | 88 |
| 0.8 | 283 | 175 | 108 |
| 0.9 | 290 | 171 | 119 |

The value of $Tc_1$ for $0.1 \leqq x \leqq 0.9$ is almost constant between 0.1 and 0.5 and is rising from 0.6 to 0.9, while $Tc_2$ is decreasing, leading thus to a rising of the temperature span, as described by the increase of $Tc_1$-$Tc_2$ with the increasing value of x.

Fe is the sole known Mn substitute yielding an increase of $T_{C1}$.

Therefore, according to a preferred embodiment, x is comprised from about 0.6 to about 1, preferably from about 0.8 to about 0.9, in particular 0.9.

According to another aspect, the invention relates to a composition having the following general formula (VII):

$$(A,B) \qquad \text{(VII)}$$

in which:

A is at least one compound as defined above,

B is at least a second magnetocaloric material having a transition peak comprised from about 300 to about 350 K chosen from the group consisting of Gd, $MgMn_6Sn_6$, $Mn_4Ga_2Sn$, $Gd_5(Si_{1-z},Ge_z)_4$, $MnFeP_{1-z}As_z$, z being comprised from 0 to 1, as a magnetocaloric agent, in particular for magnetic refrigeration.

A composition can be made consisting in a mixture of at least one compound A and a material B, in order to still broaden the temperature span of the compounds A defined above. B can be any identified material already known presenting at least a transition peak in the temperature range 300-350K, and particularly Gd, $MgMn_6Sn_6$, $Mn_4Ga_2Sn$, $Gd_5Si_2Ge_2$, MnFePAs;

In the composition, A is working in the low temperature range (150K-300K) and B is working in the high temperature range (300K-350K).

The B material can be a FOMT or SOMT material.

The composition can be made with a mixture of the powders of compound A and material B or a multi layer mixture of each constituent.

According to a preferred embodiment, the invention relates to one of the above defined compositions wherein the ratio (w/w) between A and B is from about 0.01 to about 99, particularly from about 0.1 to about 10 and more particularly from about 0.5 to about 5.

Therefore, depending on the compounds and materials introduced as well as their respective ratio, it is possible to modulate the magnetic entropy and the temperature span, allowing thus to adapt the composition to the desired refrigeration system.

According to another preferred embodiment, the invention relates to the use of one of the above defined compositions wherein the cooling capacity q for a magnetic field applied from about 0 to about 5 T is comprised from about 50 $mJ/cm^3$ to about 5000 $mJ/cm^3$ particularly from about 100 $mJ/cm^3$ to about 4000 $mJ/cm^3$, more particularly from about 500 $mJ/cm^3$ to about 3500 $mJ/cm^3$ and more particularly from about 1000 $mJ/cm^3$ to about 3000 $mJ/cm^3$.

According to another preferred embodiment, the invention relates to the use of one of the above defined compositions wherein said peaks are in a temperature range from about 50 K to about 600 K, particularly from about 100 K to about 500 K, more particularly from about 150 K to about 400 K and more particularly from about 150 K to about 350 K.

One of the advantages of the compositions of the invention is to broaden the temperature of use of said compositions in comparison to the existing materials B or the compounds A defined above taken alone, while lowering the cost of the composition thanks to the lower quantity of material B introduced.

According to a more preferred embodiment, the invention relates to the use of at least one of the above defined compositions wherein the temperature range between at least two adjacent peaks and particularly between all the adjacent peaks is comprised from about 20 K to about 150 K.

According to another aspect, the invention relates to a magnetocaloric material having the following general formula (I) and a crystalline structure of $Ni_3Sn_2$ type:

$$Mn_{3-(x+x')}Fe_xT'_{x'}Sn_{2-(y+y')}X_yX'_{y'} \qquad \text{(I)}$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X and X' are chosen among: Ga, Ge, Sb, In, Al, Cd, As, P, C, Si, $0.5<x \leqq 1$, and $x' \leqq 0.5$ y and y' are comprised from 0 to 0.5, $y+y' \leqq 1$, and $x+x'+y+y' \leqq 2.5$.

Therefore, the compounds of formula (I) are alloys comprising six elements.

According to another preferred embodiment, the invention relates to one of the above defined magnetocaloric materials, having the following general structure (II):

$$Mn_{3-x}Fe_xSn_{2-(y+y')}X_yX'_{y'} \qquad \text{(II)}$$

in which:

X and X' are chosen among: Ga, Ge, Sb, In, Al, Cd, As, P, C, Si, $0.5<x \leqq 1$, y and y' are comprised from 0 to 0.5, $y+y' \leqq 1$,and $x+y+y' \leqq 2.0$.

Therefore, the compounds of formula (II) are alloys comprising five, four or three elements depending of the value of y and y'.

According to another preferred embodiment, the invention relates to one of the above defined magnetocaloric materials having the following general structure (III):

$$Mn_{3-(x+x')}Fe_xT'_{x'}Sn_{2-y}X_y \qquad \text{(III)}$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X is chosen among: Ga, Ge, Sb, In, Al, Cd, As, P, C, Si,
$0.5<x\leqq 1$, and $x'<0.5$,
y is comprised from 0 to 1,
and $x+x'+y\leqq 2.5$.

Therefore, the compounds of formula (III) are alloys comprising five, four or three elements depending of the value of y and x'.

According to another preferred embodiment, the invention relates to one of the above defined magnetocaloric materials having the following general formula (IV) and a crystalline structure of $Ni_3Sn_2$ type:

$$Mn_{3-x}Fe_xSn_{2-y}X_y \quad (IV)$$

in which:
X is chosen among: Ga, Ge, Sb, In, Al, Cd, As, P, C, Si,
$0.5<x\leqq 1$,
y is comprised from 0 to 1,
and $x+y\leqq 2$.

Therefore, the compounds of formula (IV) are alloys comprising four or three elements depending of the value of y.

According to another preferred embodiment, the invention relates to one of the above defined magnetocaloric materials having the following general formula (V):

$$Mn_{3-(x+x')}Fe_xT'_xSn_2 \quad (V)$$

in which:
T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu,
$0.5<x\leqq 1$,
and $x'<0.5$.
Therefore, the compounds of formula (V) are alloys comprising four or three elements depending of the value of x'.

According to another preferred embodiment, the invention relates to one of the above defined magnetocaloric materials having the following general formula (VI) and a crystalline structure of $Ni_3Sn_2$ type:

$$Mn_{3-x}Fe_xSn_2 \quad (VI)$$

in which:
$0.5<x\leqq 1$.

Therefore, the compounds of formula (VI) are alloys comprising three elements.

According to another preferred embodiment, the invention relates to one of the above magnetocaloric materials wherein the variation of the magnetic entropy ($-\Delta S_M$) versus the temperature for a magnetic field applied from more than 0 to about 5 T is comprised from about 5 mJ/cm$^3$/K to about 50 mJ/cm$^3$/K particularly between 10 mJ/cm$^3$/K to about 40 mJ/cm$^3$/K, more particularly from about 15 mJ/cm$^3$/K to about 35 mJ/cm$^3$/K and more particularly from about 20 mJ/cm$^3$/K to about 30 mJ/cm$^3$/K.

According to another preferred embodiment, the invention relates to one of the above above defined magnetocaloric material wherein the variation of the adiabatic temperature ($\Delta T_{ad}$) for a magnetic field applied from 0 to about 5 T is comprised from about 0.5 K to about 5 K, particularly from about 1 K to about 4 K and more particularly from about 1.5 K to about 3 K.

According to another preferred embodiment, the invention relates to one of the above magnetocaloric materials wherein said two peaks are in a temperature range from about 50 K to about 550 K, particularly from about 100 K to about 400 K, more particularly from about 150 K to about 350 K and more particularly from about 150 K to about 300 K.

According to another preferred embodiment, the invention relates to one of the above magnetocaloric materials wherein the temperature range between at least two adjacent peaks and particularly between all the adjacent peaks is comprised from about 20 K to about 150 K.

According to another preferred embodiment, the invention relates to one of the above magnetocaloric material chosen from the group consisting of:

$Mn_{3-x}Fe_xSn_2$ $Mn_{3-x}Fe_xSn_{2-y}Ge_y$ $Mn_{3-x}Fe_xSn_{2-y}In_y$ wherein $0.5<x\leqq 1$, y is comprised from 0 to 1, and $x+y\leqq 2$.

According to another preferred embodiment, the invention relates to one of the above magnetocaloric materials chosen from the group consisting of:

$Mn_{3-x}Fe_xSn_2$ where $0.5<x\leqq 0.1$,

The replacement of a part of Mn by a content of Fe above 0.5 leads to compounds, the temperature span and variation of entropy of which can be modulated (Table II and FIG. 4)

TABLE II

| Compound | $Tc_1$ (K) | $Tc_2$ (K) | $\Delta S_{M1}$ at 5T (mJ · cm$^{-3}$ · K$^{-1}$) | $RCP_1$ (mJ cm$^{-3}$) | $\Delta S_{M2}$ at 5T (mJ · cm$^{-3}$ · K$^{-1}$) | $RCP_2$ (mJ cm$^{-3}$) | q (mJ · cm$^{-3}$) |
|---|---|---|---|---|---|---|---|
| $Mn_3Sn_2$ | 262 | 227 | 27.2 | 1466 | 26.4 | 870 | 1866 |
| $Mn_{2.4}Fe_{0.6}Sn_2$ | 268 | 185 | 25.3 | 1570 | 11.5 | 530 | 1890 |
| $Mn_{2.3}Fe_{0.7}Sn_2$ | 271 | 183 | 24.4 | 1510 | 10.5 | 520 | 2010 |
| $Mn_{2.2}Fe_{0.8}Sn_2$ | 283 | 175 | 23.0 | 1380 | 8.4 | 400 | 1770 |
| $Mn_{2.1}Fe_{0.9}Sn_2$ | 290 | 171 | 20.6 | 1350 | 6.9 | 330 | 1960 |

According to another preferred embodiment, the invention relates to one of the above defined magnetocaloric materials wherein the phase transition of said magnetocaloric material comprising at least two phase transitions, each of them being of second order and constituting a peak.

According to another preferred embodiment, the invention relates to one of the above defined magnetocaloric materials wherein the cooling capacity for a magnetic field applied from 0 to about 5 T is comprised from about 50 mJ/cm$^3$ to about 5000 mJ/cm$^3$ particularly from about 100 mJ/cm$^3$ to about 4000 mJ/cm$^3$, more particularly from about 500 mJ/cm$^3$ to about 3000 mJ/cm$^3$ and more particularly from about 1000 mJ/cm$^3$ to about 2000 mJ/cm$^3$.

As shown on FIGS. 4, 7 and 8 and Table II, the chemical substitution on Mn and Sn sublattice allows varying the transition temperatures ($TC_1$ and $TC_2$) as well as the magnitude of corresponding magnetocaloric effect.

As it can be seen on FIG. 4, above 0.5, the temperature span of use is greatly enlarged, reaching about 120 K for $Mn_{2.1}Fe_{0.9}Sn_2$ more than two fold the temperature span of for $Mn_{2.9}Fe_{0.1}Sn_2$ (54 K).

The cooling capacity q remains almost constant upon Fe substitution but the refrigerant capacity is increased at high temperature (the magnitude of the peak at $T_{C1}$ remains almost constant while its width increases) and decreased at low temperature (the magnitude of the peak at $T_{C2}$ decreases).

Consequently, the chemical substitutions allow to tune the temperature span, working temperatures and shape of the magnetocaloric response. It is thus possible to design this shape to that required by the employed refrigeration cycle.

According to another aspect, the invention relates to a magnetocaloric composition having the following general formula (VII):

$$(A,B) \quad \text{(VII)}$$

in which:

A is at least one compound as defined above,

B is at least a second magnetocaloric material having a transition peak comprised from about 300 to about 350 K chosen from the group consisting of Gd, $MgMn_6Sn_6$, $Mn_4Ga_2Sn$, $Gd_5(Si_{1-z}Ge_z)_4$, $MnFeP_{1-z}As_z$, z being comprised from 0 to 1.

According to a preferred embodiment, the invention relates to the use of a magnetocaloric composition above defined, wherein the ratio (w/w) between A and B is from about 0.01 to about 99, particularly from about 0.1 to about 10 and more particularly from about 0.5 to about 5.

According to a preferred embodiment, the invention relates to the use of one of the above defined magnetocaloric composition chosen from the group consisting of:

$Mn_3Sn_2$ and Gd, $Mn_3Sn_2$ and $MgMn_6Sn_6$, $Mn_3Sn_2$ and $Mn_4Ga_2Sn$, $Mn_3Sn_2$ and $Gd_5(Si_{1-z}Ge_z)_4$, $Mn_3Sn_2$ and $MnFeP_{1-z}As_z$, $Mn_{3-x}Fe_xSn_2$ and Gd, $Mn_{3-x}Fe_xSn_2$ and $MgMn_6Sn_6$, $Mn_{3-x}Fe_xSn_2$ and $Mn_4Ga_2Sn$, $Mn_{3-x}Fe_xSn_2$ and $Gd_5(Si_{1-z}Ge_z)_4$, $Mn_{3-x}Fe_xSn_2$ and $MnFeP_{1-z}As_z$, x being as above defined above.

The invention also relates to a process of preparation of the compound of formula (I) having a crystalline structure of $Ni_3Sn_2$ type:

$$Mn_{3-(x+x')Fe_x}T'_xSn_{2-(y+y')}X_yX'_{y'} \quad \text{(I)}$$

in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X and X' are chosen among: Ga, Ge, Sb, In, Al, Cd, As, P, C, Si, $0.5<x\leqq 1$, and and $x'\leqq 0.5$ y and y' are comprised from 0 to 0.5, $y+y'\leqq 1$, and $x+x'+y+y'\leqq 2.5$, comprising a first step of annealing a homogenized mixture of the elements Mn, Fe, T', Sn, X and X', in an appropriate amount, at a temperature from about 550° C. to about 850° C., particularly at a temperature from about 600° C. to about 800° C. and more particularly from 650° C. to about 750° C., grinding the mixture thus obtained and a second step of annealing at a temperature below 480° C., preferably from about 450° C. to about 480° C., said homogenised mixture being prepared by sintering a mixture of the elements Mn, Fe, T', Sn, X and X', in an appropriate amount, X and X' being as above defined, in particular pure elements, at a temperature range from 300 to 600° C.

The sintering step is carried out to combine and homogenize the mixture of the elements.

During the second step of annealing, the treatment of this homogenised mixture, at a temperature below 480° C., is essential to lead to a unique compound $Mn_3Sn_2$ having a $Ni_3Sn_2$ structure type.

According to a preferred embodiment, the invention relates to a process of preparation as defined above, wherein said homogenized mixture prepared by sintering a mixture of the elements Mn, Fe, T', Sn, X, X', is first ground to obtain an amorphous or micro-crystalline mixture.

The grinding is realised to obtain a homogenized powder in the form of an amorphous or micro-crystalline mixture.

According to a preferred embodiment, the invention relates to a process of preparation as defined above to obtain a compound of formula (I) in which:

T' is chosen among: Ti, V, Cr, Fe, Co, Ni, Cu, Zn, Ru, Zr, Hf, Nb, Mo, or a rare earth element selected from the group consisting in: La, Ce, Pr, Nd, Sm, Eu, Gd, Tb, Dy, Ho, Er, Tm, Yb, Sc, Y, Lu, X and X' chosen among: Ga, Ge, Sb, In, Al, Cd, As, P, C, $0.5<x\leqq 1$, and and $x'\leqq 0.5$ y and y' are comprised from 0 to 0.5, $y+y'\leqq 1$, and $x+x'+y+y'\leqq 2.5$, comprising:

a) optionally grinding a mixture of the elements Mn, Fe, T', Sn, X and X', in an appropriate amount to obtain an amorphous or micro-crystalline mixture, b) sintering said amorphous or micro-crystalline mixture at a temperature comprised from 300 to 600° C. to obtain a homogenized mixture, c) crushing and compacting said homogenized mixture to obtain a crushed and compacted mixture, d) annealing said crushed and compacted mixture in a first step at a temperature comprised from 650° C. to 750° C., grinding the mixture thus obtained and annealing in a second step at a temperature below 480° C., preferably from about 450° C. to about 480° C.

The above defined compounds can be used for magnetic refrigeration in systems such as near room temperature magnetic refrigerators (FIGS. 5 and 6), freezers, conditioned air, gas liquefaction, cooling of electronic components, heat pump (FIG. 5).

DESCRIPTION OF THE FIGURES

FIG. 2 represents the crystallographic data of $Mn_{3-x}Cu_xSn_2$ (x=0.1, 0.2 and 0.3) samples.

EXAMPLES

1) General Procedure for the Synthesis of the Different Compounds:

The alloys and compounds with general composition $Mn_{3-(x+x')}T'_xSn_{2-(y+y')}X_yX'_y$ are prepared by mixing the pure commercially available elements in suitable weight proportion. The mixtures can be mixed by hand or ball-milled to obtain an amorphous or micro-crystalline mixture in order to reduce the annealing time.

The resulting mixtures are compressed into pills using for instance a steel die. The pellets are then enclosed into silica tubes sealed under inert atmosphere (e.g. 300 mm Hg of purified argon) to avoid any oxidization during the thermal treatment.

The sintering stage (i.e. the first thermal treatment) is conducted at 450-500° C. during 2-3 days. At this temperature Sn, one of the main constituent, is in liquid state. The quartz ampoule is then quenched in water and the pellets are tightly ground by hand.

The crushed mixtures are then compacted again, and introduced into silica tubes sealed under inert atmosphere. The pellets are then subsequently heated for one week before to be quenched in ice/water. This part of the synthesis procedure is conducted at 700° C.

After this week of annealing, the pellets are tightly ground again, compacted, introduced into silica ampoules under protective atmosphere.

The final thermal treatment must be conducted below 480° C. (preferably between 450 and 480° C.) for at least one weak whatever the composition to be sure to stabilize the $Ni_3Sn_2$ type of structure and not the lacunary $Ni_2In$-type which is formed at higher temperatures.

Indeed, that is the $Ni_3Sn_2$-type which yields the desired and unusual two-peak magnetocaloric effect whereas compounds which crystallize in the lacunary $Ni_2In$-type only display a single peak. After this final heating, the samples are quenched in ice/water.

2) Characteristics of the Compounds

Some of the different compounds synthesized have been characterized by their X-ray diffraction pattern.

The crystallographic data of the compounds are given in Table III.

TABLE III

| Compound | a (Å) | b (Å) | c (Å) |
|---|---|---|---|
| $Mn_{2.4}Fe_{0.6}Sn_2$ | 7.495 (1) | 5.459 (1) | 8.497 (1) |
| $Mn_{2.3}Fe_{0.7}Sn_2$ | 7.489 (1) | 5.456 (1) | 8.487 (1) |
| $Mn_{2.2}Fe_{0.8}Sn_2$ | 7.478 (1) | 5.446 (1) | 8.474 (1) |
| $Mn_{2.1}Fe_{0.9}Sn_2$ | 7.471 (2) | 5.440 (1) | 8.466 (1) |

3) Synthesis of the Compositions (A, B)

To prepare the (A,B) hybrid material, powders of the A and B compounds can be mixed by hand (or ball-milled) or can be arranged into layers in necessary order (i.e. the compound with the higher ordering temperature near the hot end, the compound with the lower ordering temperature near the cold end).

4) Schematic Functioning of the Magnetic Refrigeration and the Heat Pump

Figure 1:
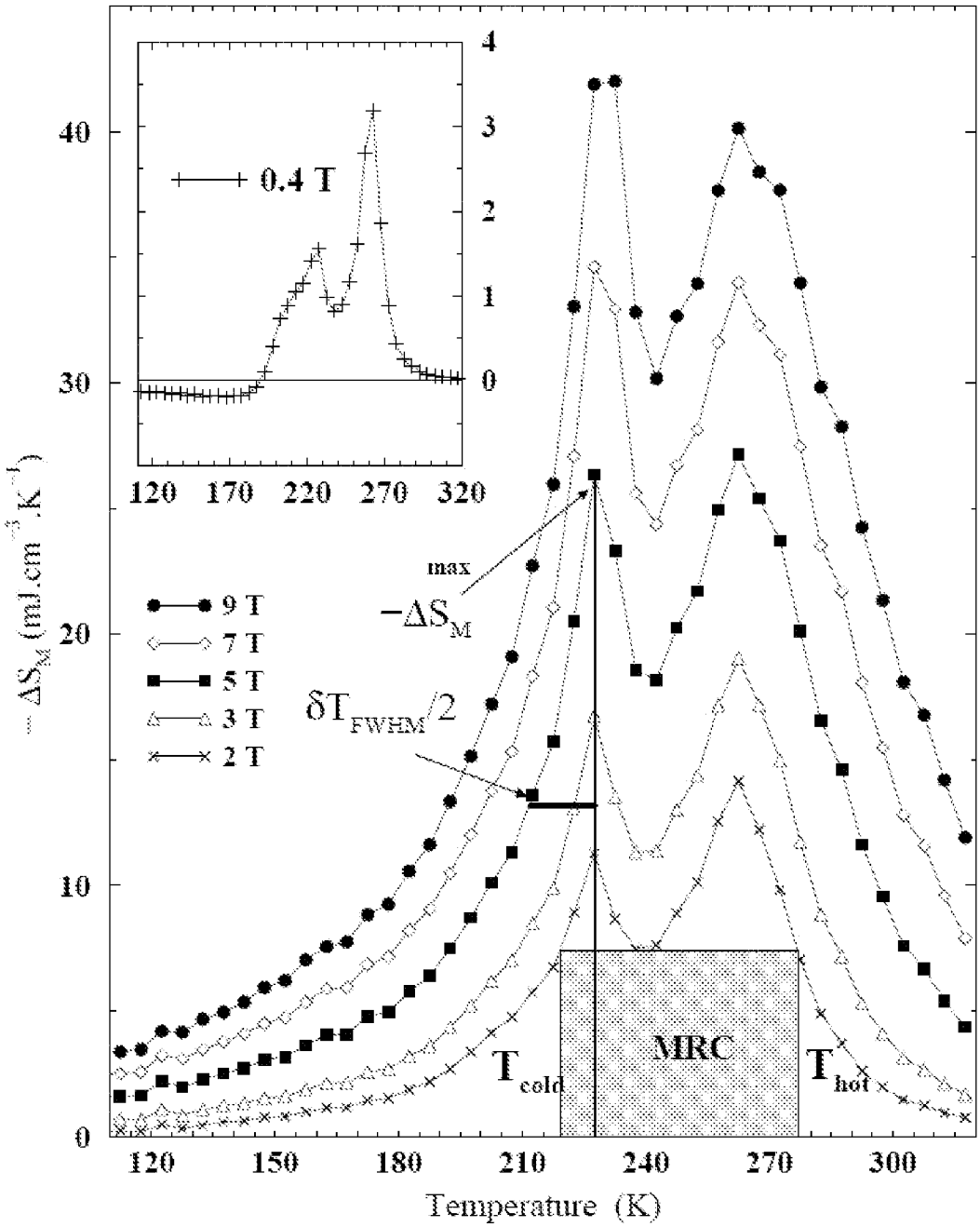
FIG. 1 represents the thermal variation of the magnetic entropy (y-axis ($mJ.cm^{-3}.K^{-1}$)) versus temperature (x-axis, ° K) of $Mn_3Sn_2$ for a field change of 2T (black crosses), 3T (white triangles), 5T (black squares), 7T (white diamond), and 9T (black circles. On this figure are also indicated $-\Delta S_M^{max}$, $\delta T_{FWHM}/2$, $T_{cold}$, $T_{hot}$ and MRC as defined in the specification.
Figure 3:
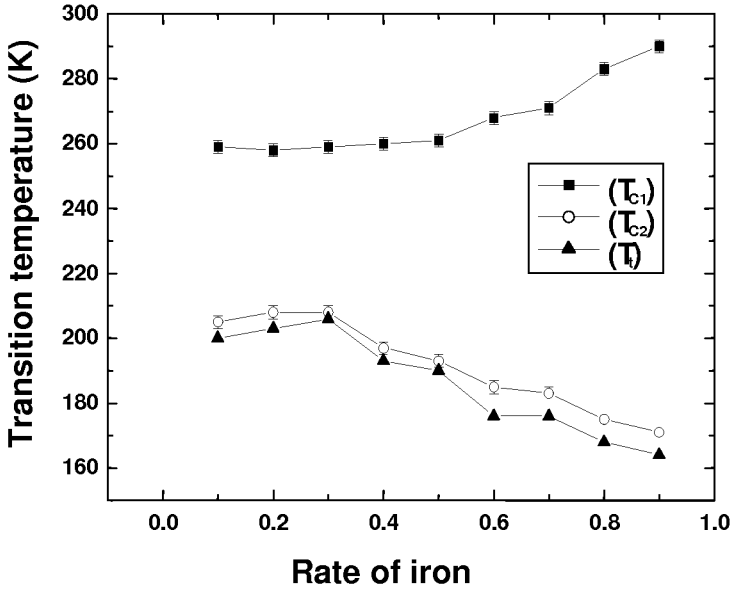
FIG. 3 represents the transition temperature (y-axis; ° K) versus the rate (x-axis) of iron (A: $Mn_{3-x}(Fe_xSn_2$ samples; x=0.1 to 1; black squares: $T_{C1}$; white circles: $T_{C2}$; black triangles: $T_t$)), or copper (B: $Mn_{3-x}Cu_xSn_2$ samples; x=0.1 to 0.3; black squares: $T_{C1}$; white circles: $T_{C2}$)).
Figure 3:
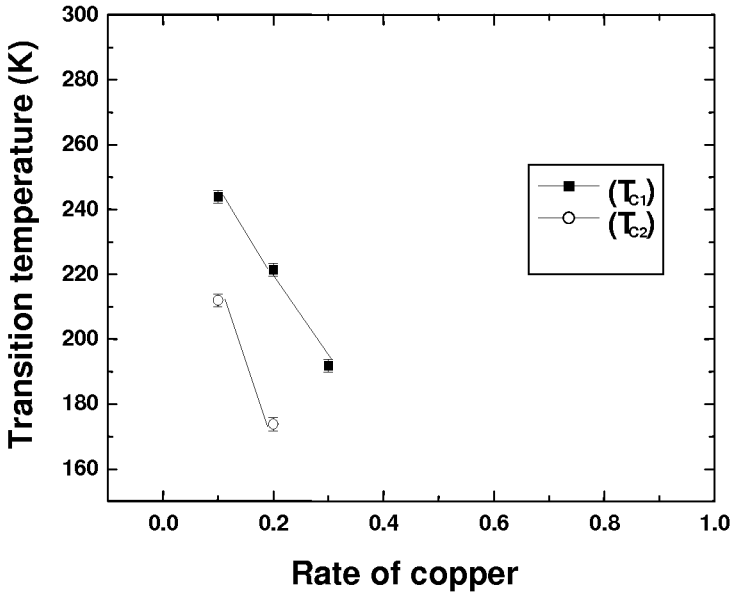
Figure 4:
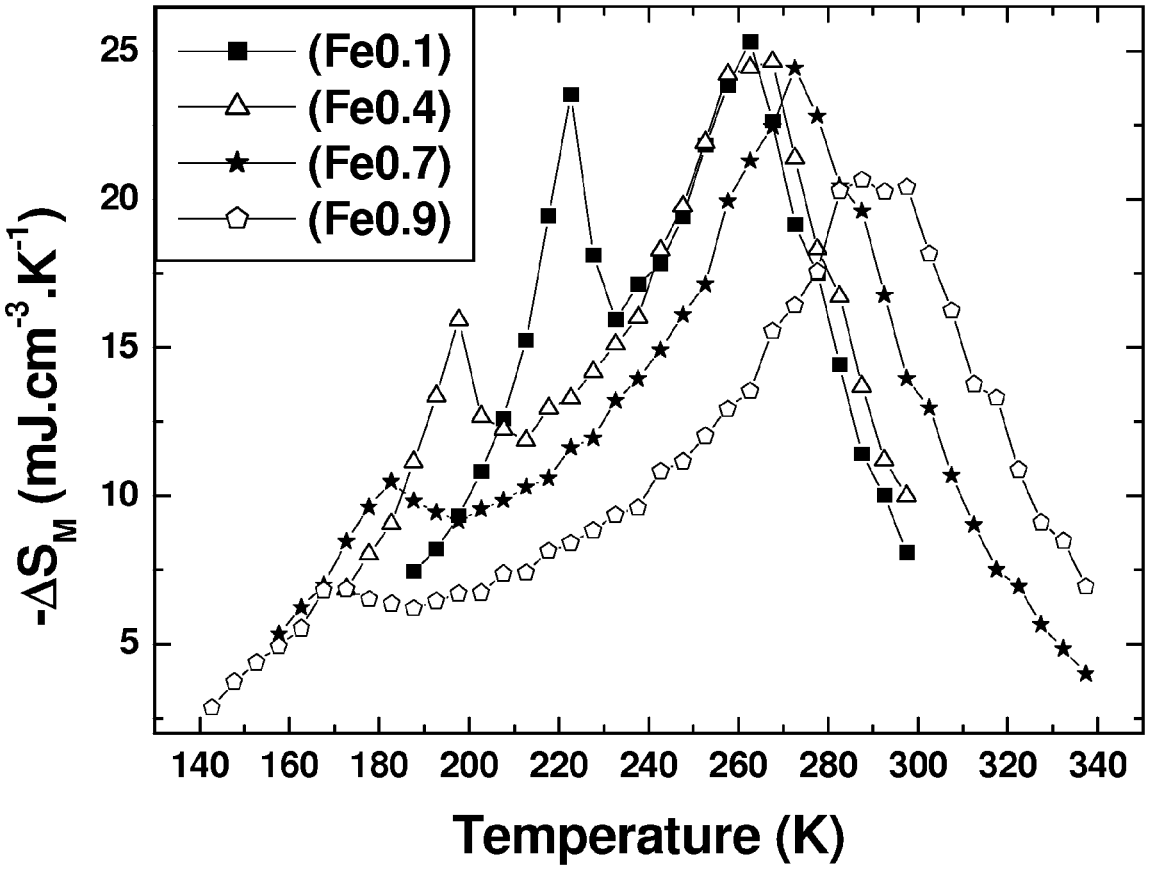
FIG. 4 represents the thermal variation of the magnetic entropy (y-axis ($mJ.cm^{-3}.K^{-1}$)) versus temperature (x-axis, ° K) of $Mn_{3-x}Fe_xSn_2$ for a field change of 5T for x=0.1 (black square), 0.4 (white triangle), 0.7 (black star), 0.9 (white pentagon).
Figure 5:
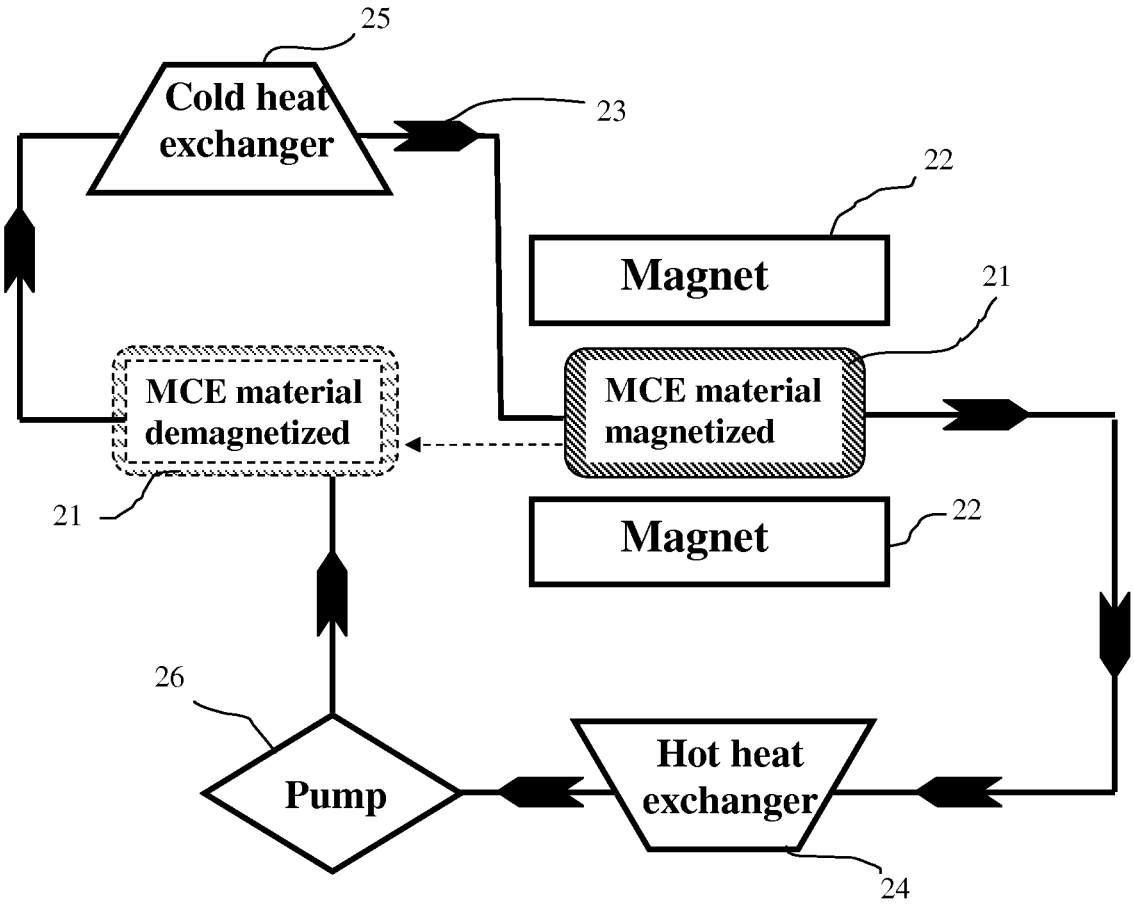
FIG. 5 is a schematic view illustrating an embodiment of a refrigeration system utilizing a magnetocaloric material according to the present invention.

FIG. 5 illustrates a working principle of the magnetic refrigeration using a magnetocaloric material according to the present invention. It concerns an example of a magnetic refrigeration system in which the magnetocaloric material 21 (MCE material) according to the invention is adapted for operation. This magnetic refrigeration system is characterized by a linear displacement of the magnetocaloric material 21 between two positions. Into the first position, the magnetocaloric material 21 is magnetized thanks to a permanent magnet 22 surrounding said magnetocaloric material 21. Whereas, into a second position, as depicted in dotted line in FIG. 15, the magnetocaloric material 21 is demagnetized as it is out of the permanent magnet 22. Conventional means of known type, not shown, may be utilized to provide linear displacement of the magnetocaloric material 21. Another variant may consist in a displacement of the permanent magnet 22 with a fixed magnetocaloric material 21. A flow 23 of a heat transfer fluid is controllably passed through the magnetocaloric material 21, a hot heat exchanger 24 and a cold heat exchanger 25 with the aid of conventional means such as a pump 26. The operation of the system as illustrated in FIG. 5 may be embodied in a cyclic manner in order to obtain magnetic refrigeration. At the beginning of the cycle, the system is at room temperature or below. A magnetic field in then applied to the magnetocaloric material 21 with the permanent magnet 22 (Neodyne magnet, 0.1-10 Hz) causing an alignment of the material moments and thus an increase of the temperature.

The temperature is then exchanged with the hot heat exchanger 24, allowing the magnetocaloric material 21 to return to the initial temperature.

The magnetocaloric material 21 is demagnetized by switching off the applied field, causing an alignment of the material moments and thus a decrease of the temperature below the room temperature.

The temperature is then exchanged with a cold heat exchanger 25 (refrigerator).

The working principle of the heat pump is the same as above, except the hot and cold sources are switched.

5) Arrangement of a Magnetic Refrigeration System

Figure 6:
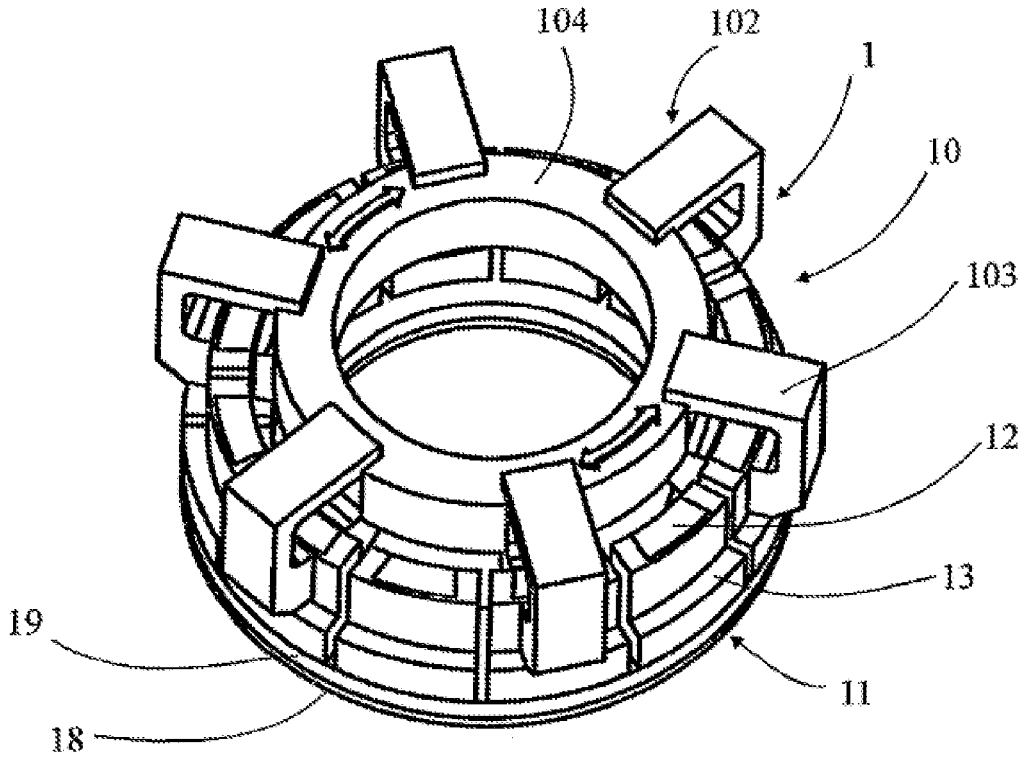
FIG. 6 represents a schematic view of the arrangement of a magnetic refrigeration system (WO 2005/043052).
Figure 7:
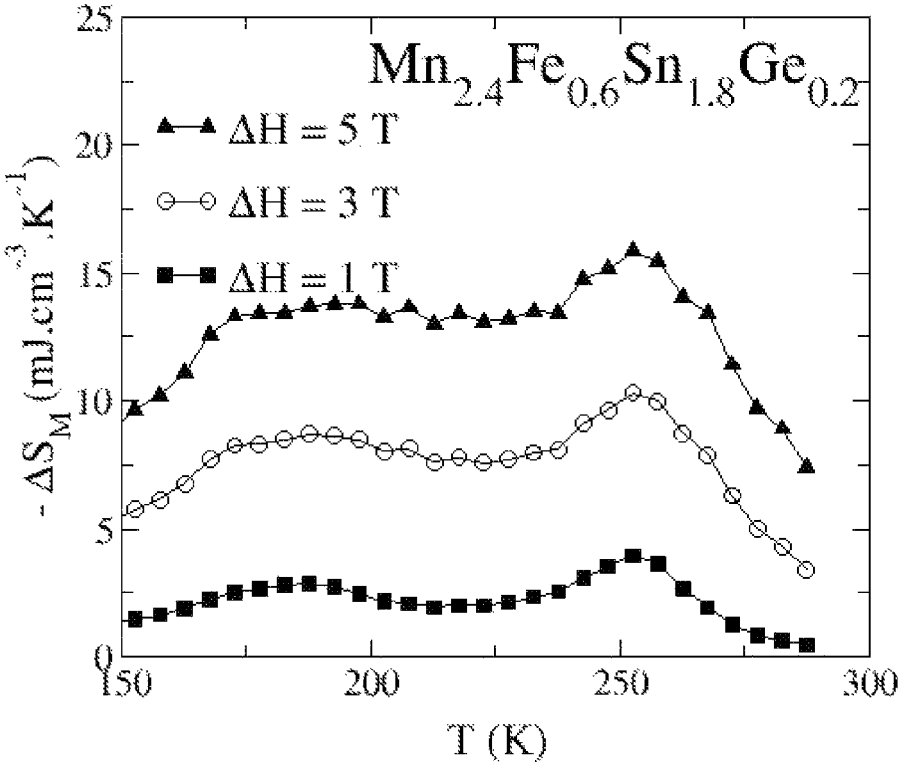
FIG. 7 represents the thermal variation of the magnetic entropy (y-axis ($mJ.cm^3.K^{-1}$)) versus temperature (x-axis, ° K) of $Mn_{2.4}Fe_{0.6}Sn_{1.8}Ge_{0.2}$ for a field change of 1T (black squares), 3T (white circles) and 5T (black triangles).
Figure 8:
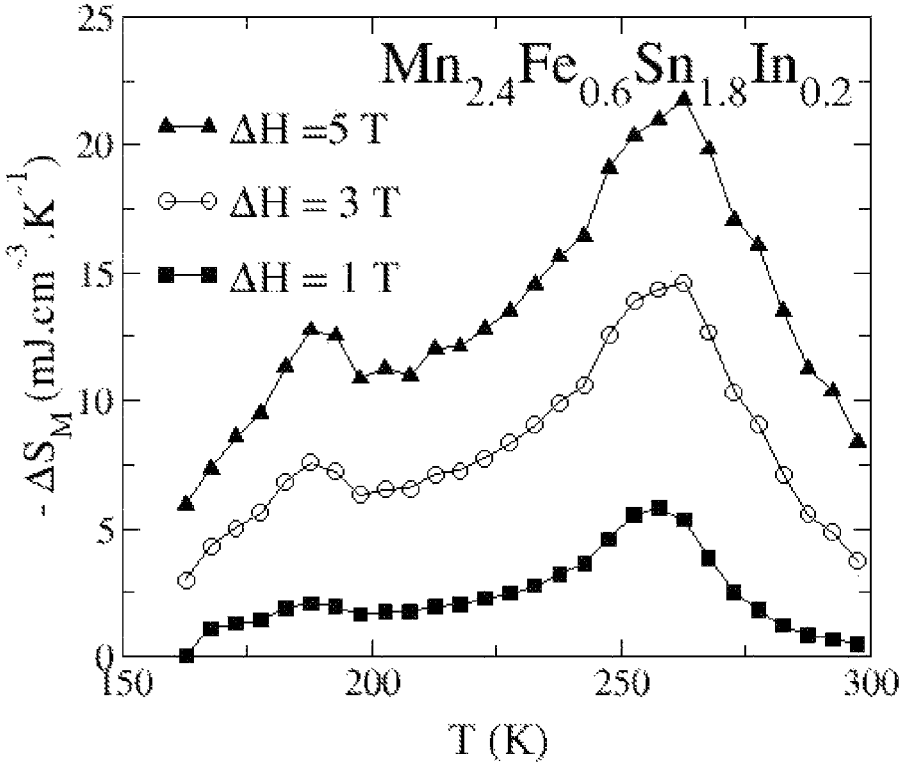
FIG. 8 represents the thermal variation of the magnetic entropy (y-axis ($mJ.cm^3.K^{-1}$)) versus temperature (x-axis, ° K) of $Mn_{2.4}Fe_{0.6}Sn_{1.8}In_{0.2}$ for a field change of 1T (black squares), 3T (white circles) and 5T (black triangles).
Figure 9:
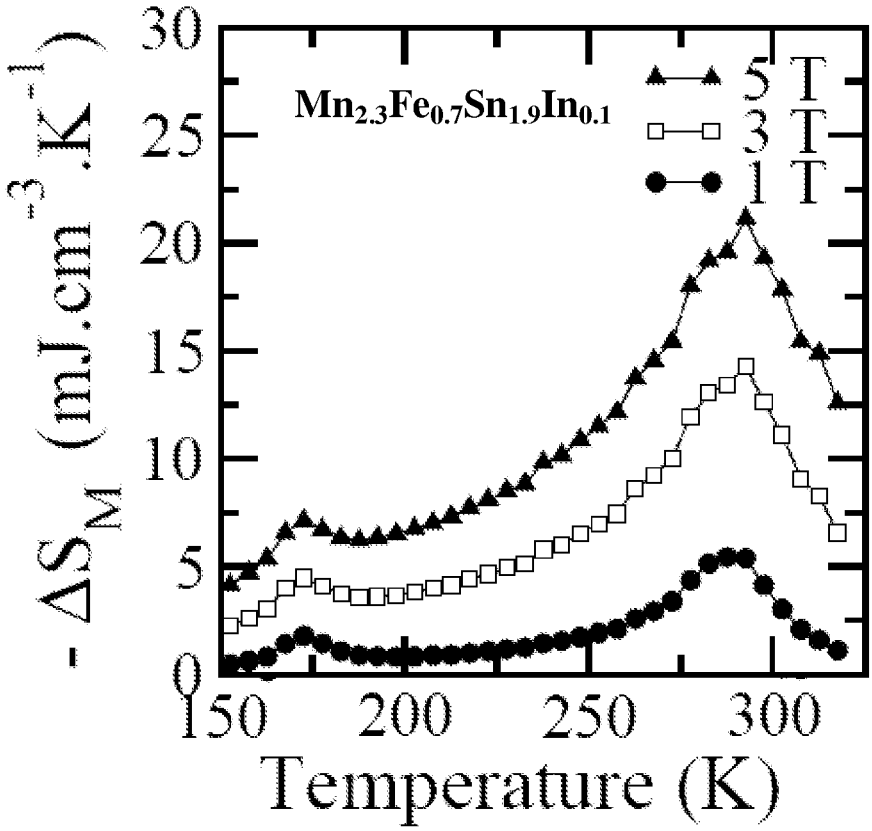
FIG. 9 represents the thermal variation of the magnetic entropy (y-axis ($mJ.cm^3.K^{-1}$)) versus temperature (x-axis, ° K) of $Mn_{2.3}Fe_{0.7}Sn_{1.9}In_{0.1}$ for a field change of 1T (black circles), 3T (white squares) and 5T (black triangles).

An example of magnetic refrigeration system using the magnetocaloric compounds or compositions of the present invention is represented in FIG. 6.

This system 1 is composed of a thermic flux generator 10 comprising twelve thermic parts 11 forming a circle and containing the magnetocaloric compound or the compositions of the invention (500 g-1 kg) 12. Each thermic part 11 is connected to a thermically conductor element 13 which transmits the hot (or cold) heat from 12 to 11, depending if the field is applied or not by means of magnet elements 102, 103 fixed on a mobile support 104.

Thermic parts 11 are fixed on a plate 18 and separated by a seal 19. Both plate and seal are pierced allowing the exchange with a heat transfer fluid.

The magnetocaloric compounds or the compositions of the invention introduced in 12 can be under the form of a powder, a multi layer powder, a pill, a block.

The invention claimed is:

1. A method for magnetic refrigeration comprising:

providing refrigeration using a magnetocaloric agent consisting of at least one compound having the following general formula (I) and a crystalline structure of $Ni_3Sn_2$ type:

$$Mn_{3-(x+x')}Fe_xT'_{x'}Sn_{2-(y+y')}X_yX'_{y'} \quad (I),$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X and X' are selected from the group consisting of: Ga, Ge, Sb, In, Al, Cd, As, P, C, and Si, $0.5<x\leqq 1$, $x'\leqq 0.5$ $0\leqq y\leqq 0.5$, $0\leqq y'\leqq 0.5$ $y+y'\leqq 1$, and $x+x'+y+y'\leqq 2.5$.

2. The method for magnetic refrigeration according to claim 1, wherein the at least one compound has the following general formula (II) and a crystalline structure of $Ni_3Sn_2$ type:

$$Mn_{3-x}Fe_xSn_{2-(y+y')}X_yX'_{y'} \quad (II),$$

in which:

X and X' are selected from the group consisting of: Ga, Ge, Sb, In, Al, Cd, As, P, C, and Si, $0.5<x\leqq 1$, $0\leqq y\leqq 0.5$, $0\leqq y'\leqq 0.5$, $y+y'\leqq 1$, and $x+y+y'$ 2.0.

3. The method for magnetic refrigeration according to claim 1, wherein the at least one compound has the following general formula (III) and a crystalline structure of $Ni_3Sn_2$ type:

$$Mn_{3-(x+x')}Fe_xT'_{x'}Sn_{2-y}X_y \quad (III),$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X is selected from the group consisting of: Ga, Ge, Sb, In, Al, Cd, As, P, C, and Si, $0.5<x\leqq 1$, $x'<0.5$, $0\leqq y\leqq 1$, and $x+x'+y\leqq 2.5$.

4. The method for magnetic refrigeration according to claim 1, wherein the at least one compound has the following general formula (IV) and a crystalline structure of $Ni_3Sn_2$ type:

$$Mn_{3-x}Fe_xSn_{2-y}X_y \quad (IV),$$

in which:

X is selected from the group consisting of: Ga, Ge, Sb, In, Al, Cd, As, P, C, and Si, $0.5<x\leqq 1$, $0\leqq y\leqq 1$, and $x+y\leqq 2$.

5. The method for magnetic refrigeration according to claim 1, wherein the at least one compound has the following general formula (V) and a crystalline structure of $Ni_3Sn_2$ type:

$$Mn_{3-(x+x')}Fe_xT'_{x'}Sn_2 \quad (V),$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, $0.5<x\leqq 1$, and $x'<0.5$.

6. The method for magnetic refrigeration according to claim 1, wherein the at least one compound has the following general formula (VI) and a crystalline structure of $Ni_3Sn_2$ type:

$$Mn_{3-x}Fe_xSn_2 \quad (VI),$$

in which:

$0.5<x\leqq 1$.

7. The method for magnetic refrigeration according to claim 1, wherein the at least one compound has a cooling capacity q for a magnetic field applied from 0 to 5 T from 50 $mJ/cm^3$ to 5000 $mJ/cm^3$.

8. The method for magnetic refrigeration according to claim 1, wherein the at least one compound presents two transition temperature peaks which are in a temperature range from 50 K to 550 K.

9. The method for magnetic refrigeration according to claim 1, wherein the at least one compound presents two transition temperature peaks which are in a temperature range from 50 K to 550 K, wherein the temperature range between at least two adjacent transition temperature peaks is from 20 K to 150 K.

10. A method for magnetic refrigeration comprising:

providing refrigeration using a composition having the following general formula (VII):

$$(A,B) \quad (VII),$$

in which:

A is at least one compound as defined in claim 1,

B is at least a second magnetocaloric material having a transition temperature peak from 300 to 350 K.

11. The method for magnetic refrigeration according to claim 10, wherein the ratio (w/w) between A and B is from 0.01 to 99.

12. The method for magnetic refrigeration according to claim 10, wherein the composition has a cooling capacity for a magnetic field applied from 0 to 5 T from 50 $mJ/cm^3$ to 5000 $mJ/cm^3$.

13. The method for magnetic refrigeration according to claim 10, wherein said transition temperature peak is in a temperature range from 50 K to 600 K.

14. The method for magnetic refrigeration according to claim 10, wherein said transition temperature peak is in a temperature range from 50 K to 600 K, and wherein the temperature range between at least two adjacent transition temperature peaks is from 20 K to 150 K.

15. A magnetocaloric material having the following general formula (I) and a crystalline structure of $Ni_3Sn_2$ type:

$$Mn_{3-(x+x')}Fe_xT'_{x'}Sn_{2-(y+y')}X_yX'_{y'} \quad (I),$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X and X' are selected from the group consisting of: Ga, Ge, Sb, In, Al, Cd, As, P, C, and Si, $0.5<x\leqq 1$, $x'\leqq 0.5$, $0\leqq y\leqq 0.5$, $0\leqq y'\leqq 0.5$, $y+y'\leqq 1$, and $x+x'+y+y'\leqq 2.5$.

16. The magnetocaloric material according to claim 15, having the following general structure (II):

$$Mn_{3-x}Fe_xSn_{2-(y+y')}X_yX'_{y'}, \quad \text{(II)},$$

in which:

X and X' are selected from the group consisting of: Ga, Ge, Sb, In, Al, Cd, As, P, C, and Si, $0.5<x\leqq 1$, $0\leqq y\leqq 0.5$, $0\leqq y'\leqq 0.5$, $y+y'\leqq 1$, and $x+y+y'\leqq 2.0$.

17. The magnetocaloric material according to claim 15, having the following general structure (III):

$$Mn_{3-(x+x')}Fe_xT'_{x'}Sn_{2-y}X_y \quad \text{(III)},$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X is selected from the group consisting of: Ga, Ge, Sb, In, Al, Cd, As, P, C, and Si, $0.5<x\leqq 1$, $x'<0.5$, $0\leqq y\leqq 1$, and $x+x'+y\leqq 2.5$.

18. The magnetocaloric material according to claim 15, having the following general structure (IV):

$$Mn_{3-x}Fe_xSn_{2-y}X_y \quad \text{(IV)}$$

in which:

X is selected from the group consisting of: Ga, Ge, Sb, In, Al, Cd, As, P, C, and Si, $0.5<x\leqq 1$, $0\leqq y\leqq 1$, and $x+y\leqq 2$.

19. The magnetocaloric material according to claim 15, having the following general structure (V):

$$Mn_{3-(x+x')}Fe_xT'_{x'}Sn_2 \quad \text{(V)},$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, $0.5<x\leqq 1$, and $x'<0.5$.

20. The magnetocaloric material according to claim 15, having the following general structure (VI):

$$Mn_{3-x}Fe_xSn_2 \quad \text{(VI)},$$

in which:

$0.5<x\leqq 1$.

21. The magnetocaloric material according to claim 15, wherein said magnetocaloric material present at least two phase transitions, each of them being of second order and constituting a transition temperature peak.

22. The magnetocaloric material according to claim 15, wherein the magnetocaloric material has a cooling capacity q for a magnetic field applied 0 to 5 T from 50 $mJ/cm^3$ to 5000 $mJ/cm^3$.

23. The magnetocaloric material according to claim 15, comprising two transition temperature peaks which are in a temperature range from 50 K to 550 K.

24. The magnetocaloric material according to claim 15, comprising two transition temperature peaks which are in a temperature range from 50 K to 550 K, wherein the temperature range between at least two adjacent transition temperature peaks is from 20 K to 150 K.

25. The magnetocaloric material according to claim 15, selected from the group consisting of:

$Mn_{3-x}Fe_xSn_2$, $Mn_{3-x}Fe_xSn_{2-y}Ge_y$ and $Mn_{3-x}Fe_xSn_{2-y}In_y$, wherein $0.5<x\leqq 1$, $0\leqq y\leqq 1$, and $x+y\leqq 2$.

26. The magnetocaloric material according to claim 15, selected from the group consisting of:

$Mn_{3-x}Fe_xSn_2$ where $0.5<x\leqq 0.1$.

27. A magnetocaloric composition having the following general formula (VII):

$$(A,B) \quad \text{(VII)},$$

in which:

A is at least one compound as defined in claim 1,

B is at least a second magnetocaloric material having a transition temperature peak from 300 to 350 K.

28. The magnetocaloric composition according to claim 27, wherein the ratio (w/w) between A and B is from 0.01 to 99.

29. The magnetocaloric composition according to claim 27, selected from the group consisting of:

$Mn_{3-x}Fe_xSn_2$ and Gd, $Mn_{3-x}Fe_xSn_2$ and $MgMn_6Sn_6$, $Mn_{3-x}Fe_xSn_2$ and $Mn_4Ga_2Sn$, $Mn_{3-x}Fe_xSn_2$ and $Gd_5(Si_{1-z}Ge_z)_4$, and $Mn_{3-x}Fe_xSn_2$ and $MnFeP_{1-z}As_z$, and x being $0.5<x\leqq 1$,and z being 0 to 1.

30. A process of preparation of the compound of formula (I) having a crystalline structure of $Ni_3Sn_2$ type:

$$Mn_{3-(x+x')}Fe_xT'_{x'}Sn_{2-(y+y')}X_yX'_{y'}, \quad \text{(I)},$$

in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X and X' are selected from the group consisting of: Ga, Ge, Sb, In, Al, Cd, As, P, C, and Si, $0.5<x\leqq 1$, $x'\leqq 0.5$, $0\leqq y\leqq 0.5$, $0\leqq y'\leqq 0.5$, $y+y'\leqq 1$, and $x+x'+y+y'\leqq 2.5$, comprising a first step of annealing a homogenized mixture of the elements Mn, Fe, T', Sn, X and X', in an appropriate amount, at a temperature from 550° C. to 850° C., grinding the mixture thus obtained and a second step of annealing at a temperature below 480° C., said homogenised mixture being prepared by sintering a mixture of the elements Mn, Fe, T', Sn, X and X', in an appropriate amount, X and X' being pure elements, at a temperature range from 300 to 600° C.

31. The process of preparation according to claim 30, wherein said homogenized mixture prepared by sintering a mixture of the elements Mn, Fe, T', Sn, X, and X', is first ground to obtain an amorphous or micro-crystalline mixture.

32. The process of preparation according to claim 30, to obtain a compound of formula (I) in which:

T' is selected from the group consisting of: Ti, V, Cr, Fe, Co, Ni, Cu, Zn, Ru, Zr, Hf, Nb, Mo, and a rare earth element selected from the group consisting of: La, Ce, Pr, Nd, Sm, Eu, Gd, Tb, Dy, Ho, Er, Tm, Yb, Sc, Y, and Lu, X and X' selected from the group consisting of: Ga, Ge, Sb, In, Al, Cd, As, P, and C, $0.5<x\leqq 1$, $x'\leqq 0.5$ $0\leqq y\leqq 0.5$, $0\leqq y'\leqq 0.5$, $y+y'\leqq 1$, and $x+x'+y+y'\leqq 2.5$, comprising:

a) optionally grinding a mixture of the elements Mn, Fe, T', Sn, X and X', in an appropriate amount to obtain an amorphous or micro-crystalline mixture, b) sintering said amorphous or micro-crystalline mixture at a temperature from 300 to 600° C. to obtain a homogenized mixture, c) crushing and compacting said homogenized mixture to obtain a crushed and compacted mixture, d) annealing said crushed and compacted mixture in a first step at a temperature from 650° C. to 750° C., grinding the mixture thus obtained and annealing in a second step at a temperature below 480° C.

33. The method for magnetic refrigeration according to claim 10, wherein, B is selected from the group consisting of Gd, $MgMn_6Sn_6$, $Mn_4Ga_2Sn$, $Gd_5(Si_{1-z}Ge_z)_4$, and $MnFeP_{1-z}As_z$, and $0\leqq z\leqq 1$.

34. The magnetocaloric composition according to claim 27, wherein,

B is selected from the group consisting of Gd, $MgMn_6Sn_6$, $Mn_4Ga_2Sn$, $Gd_5(Si_{1-z}Ge_z)_4$, and $MnFeP_{1-z}As_z$, and $0\leqq z\leqq 1$.

* * * * *

UNITED STATES PATENT AND TRADEMARK OFFICE

CERTIFICATE OF CORRECTION

PATENT NO. : 8,424,314 B2
APPLICATION NO. : 12/935090
DATED : April 23, 2013
INVENTOR(S) : Thomas Mazet It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 282 days.

Signed and Sealed this
Eighth Day of September, 2015

Michelle K. Lee

Michelle K. Lee
*Director of the United States Patent and Trademark Office*